US006508599B2

(12) United States Patent
Blume

(10) Patent No.: US 6,508,599 B2
(45) Date of Patent: Jan. 21, 2003

(54) MULTI-REACTION CHAMBER STATIC FILM PROCESSOR WHICH ALLOWS FOR MULTIPLE OVERLAPPED-CYCLE FILM PROCESSING

(76) Inventor: Stephen Thomas Blume, 25462 Wagon Wheel Cir., Laguna Hills, CA (US) 92653

( * ) Notice: Subject to any disclaimer, the term of this patent is extended or adjusted under 35 U.S.C. 154(b) by 73 days.

(21) Appl. No.: 09/732,611

(22) Filed: Dec. 11, 2000

(65) Prior Publication Data

US 2002/0071680 A1 Jun. 13, 2002

(51) Int. Cl.[7] ..... G03D 3/02; G03D 3/08
(52) U.S. Cl. ..... 396/617; 396/625; 396/626
(58) Field of Search ..... 396/599, 617, 396/620, 625, 626, 636; 355/27–29

(56) References Cited

U.S. PATENT DOCUMENTS 3,792,487 A * 2/1974 Peres ..... 396/625
5,235,372 A * 8/1993 Blume ..... 396/625
6,020,948 A * 2/2000 Tumidei ..... 396/625
6,082,908 A * 7/2000 Tumidei ..... 396/625

* cited by examiner

*Primary Examiner*—Della J Rutledge

(57) ABSTRACT

An automated static film processor that will allow for the running of additional processing cycles of X-ray film while a previous cycle is running, comprising a housing having a pair of chemical storage reservoirs and multiple reaction chambers. The advantage of this apparatus is that a secondary operator may start processing X-ray film immediately without having to wait for completion of a previous cycle. The reaction chambers are configured so that tubing, connectors, and valves will allow chemicals to flow into and out of each reaction chamber from a single set of developer and fixer storage reservoirs. Each reaction chamber is provided with water and drain valves, and overflow protection. Each reaction chamber includes a lid that prevents light damage while X-ray film is being processed. A drying device that forces warm air into each reaction chamber is disclosed.

6 Claims, 8 Drawing Sheets

MULTI-REACTION CHAMBER STATIC FILM PROCESSOR WHICH ALLOWS FOR MULTIPLE OVERLAPPED-CYCLE FILM PROCESSING

BACKGROUND OF THE INVENTION

1. Field of the Invention

The present invention relates to a type of X-ray film processor, herein called an automated static X-ray film processor, that, in order to process X-ray film, moves chemicals into and out of one of a plurality of reaction chambers. More specifically, the present invention relates to an automated static X-ray film processor that will allow for an operator to start a film processing cycle in one reaction chamber while a previous cycle has already started and is running in another reaction chamber.

2. Prior Art

Around 1900 radiographs were just starting to be utilized in the medical, dental, veterinary, and other health related fields. This new X-ray technology greatly aided the health practitioner in diagnosing disease and injury of the hard tissues. In more recent years, radiographs, with the aid of other diagnostic techniques, have been helpful in soft tissue diagnosis.

For over sixty years exposed radiographic film has been exclusively hand developed in a darkroom. That is, in a darkroom, the film was uncovered under protective red light, then placed in developer solution, then washed, then placed in fixer solution, then washed, and then air-dried. The deficiency of manual processing is that it is very time consuming and inefficient.

In the 1970's an automated roller transport film processor was brought to market. As of this writing, roller processors are still the most common types of processor sold. This type of processor is composed of four roller racks configured one in front of the other. When x-ray film is placed in the processor, the rollers pick up the film and transport it through a series of open tanks that contain processing chemicals. X-rays are moved through developer chemical, then fixer chemical, then a water wash, and finally through a dryer area. Variations have been introduced on the roller processor model. One such variation is a type of developer that uses a nylon gauze-like material configured so that it sandwiches the film, and thereby similarly transports it through the same series of tanks and chemicals as a roller processor. Other types of processors have been marketed which use other types of transport devices, all of which use a system that moves film from one end of the processor to the other. There are several inherent deficiencies with these types of transport processors that detract from their utility. Frequently, film falls out of the transport systems and becomes lost in one of the storage tanks. The result is damaged or destroyed X-ray film. Additionally, because transport mechanisms are constantly immersed in chemical, deposits collect thereon, in turn causing the film to be scratched and damaged. Transport processors require an inordinate amount of maintenance in order to remove scum that collects on the transport mechanisms. Additionally, transport processors do not process film in patient identified groups. There is no efficient way of identifying the X-rays by patient. The result is that films from one patient can be mixed up with films from another, exposing the patient to the danger of misdiagnosis. To alleviate these and.other deficiencies, several inventors have designed and patented processors that have a single reaction chamber. Chemicals, wash water, and dryer air move into and out of this single reaction chamber. X-ray films, once placed inside, remains stationary or static therein. For the sake of this writing, this type of processor shall be designated automated static X-ray film processor. There are many advantages to this type of processor. Because X-ray films do not touch a transport device, films are not scratched, jammed, stuck together, or lost. The resultant film quality is far superior. There are no mechanisms being immersed in chemical and collecting deposits, thus substantially eliminating the need for maintenance. X-ray films are always in one location, which means the X-ray films can never be lost. Because X-ray films are batch processed, patient identity is easily accomplished. X-ray films will not be misidentified nor mixed up.

There are currently several patents that describe automated static film processors. Anthony R. Peres (U.S. Pat. No. 3,792,487) describes an automatic film processor system that has temperature-controlled containers for storing chemicals, and he claims "a film holding chamber below". Dennis C. Rebek (U.S. Pat. No. 4,054,902) describes an apparatus for developing photographic prints including a cabinet, which houses a developing tank. Heinrich Huss (U.S. Pat. No. 3,890,629) describes a device for developing photographic film with a tank containing a drum arranged for immersing the film in developing chemicals. Lasky and Wright (U.S. Pat. No. 4,097,884) describe an apparatus for processing X-ray film comprising a processing tank with valves for developing solutions and water. Wada and Ishikawa (U.S. Pat. No. 4,134,665) describe a single bath- type developing device. Stephen Blume (U.S. Pat. No. 5,235,372) describes developer and fixer reservoirs fluidly connected to a single reaction chamber. Theodore Perl (U.S. Pat. No. 3,727,533) describes a small X-ray developer where films are dropped into a developing tank. M. Mastrosimone et al (U.S. Pat. No. 3,437,030) claims a processor with a container and a means to move developer chemicals into and out of said container.

The key deficiency of static film processors is the fact that it is not possible for an operator to begin processing a second set of films once a previous set has been started and is still running. Because of this fact, static film processors are ergonomically very inefficient. The operator must wait until the first set of X-ray films is completed before a second set can be placed inside for processing.

In order to alleviate this multiple cycle deficiency, Blume Imaging, a California LLC, manufactured and sold a static film processor with a horizontal rotating lid. An exposed set of X-ray films were placed on a cassette, then attached to the lid via an attachment device. When the start key was pressed, the lid would rotate 180 degrees, moving the X-ray films down into the reaction chamber. A new upper vacant side was now available for a second set of X-ray films to be attached. A second operator would place X-ray films on a cassette, then attach the cassette to the upper lid surface via an attachment device. The X-ray films in the reaction chamber were developed, then washed, then dried. Once the primary cycle was complete, the lid would rotate the processed film up, and the second set of films down into the reaction chamber for processing. Once the processed first cycle set of films was removed from the lid, the now vacant upper lid would be ready for another set of exposed X-ray films to be attached. This early solution to the second cycle deficiency of automated static X-ray film processors proved successful, but required complex mechanics and electronics, raising the per unit cost of the processor. Assembly was also complicated. Additionally, the radius required to rotate the film into the reaction chamber made the outer dimensions of the processor quite large, which proved to be another deficiency. Further, cycles ran consecutively rather than successive but overlapped. That is, a secondary cycle cannot run while a primary cycle is running. The result is that this design is "time inefficient." Two seven-minute cycles would take at least fourteen minutes to process.

DXSS Inc., a company from the state of Washington, produces a static film processor with a single reaction chamber and a "waiting" black box which serves as a holding station for the next film group. If a first set of X-ray films are already processing, a second operator may uncover a previously exposed set of films and place them in the black box with lid. This black box is light proof, and will not allow film to be damaged. A flashing indicator light shows that X-ray films are inside, ready for processing. When a first operator removes a completed set of films from a first cycle, that first operator will place the set of films from the black box in the processor, and start another developing cycle, thus producing a "pseudo" second cycle. This solution is simple, but time consuming and inefficient. Because cycles run consecutively, a second cycle may not be completed for over fifteen minutes, interrupting the ergonomic flow of the facility. And, the possibility of error by a second operator handling the exposed X-ray films, or neglecting to place the black box film in the processor further complicates matters. The DXSS design has its own set of deficiencies.

Clearly, there must be an improvement in the design of static automated film processors. No static processor design is known that will simply and efficiently allow the running of a second cycle while a first cycle has already started. Transport processors allow operators to continually feed film in making transport processors more ergonomically efficient than all known static automatic film processor designs. Without such an improvement, automated static film processors cannot be commercially successful.

SUMMARY OF THE INVENTION

In accordance with a preferred embodiment of the present invention there is provided a plurality of X-ray film cassettes which hold X-ray films during manipulation, and an automated static X-ray film processor comprising a housing defining first and second reservoirs which are capable of storing quantities of developer and fixative agents therein. The housing further includes two or more reaction chambers, each defining a front, back, and side walls, a lower surface, and an upper rim with lid. The lid is capable of being open when X-ray films are being inserted or removed from the reaction chamber, and closed to prevent light damage to X-ray films once processing has begun. Each reaction chamber is sized and configured to receive a plurality of X-ray film cassettes with intra-oral film. Further, each reaction chamber is sized to receive cassettes that hold panographic (12"×6") and cephalometric (8"×10") extra-oral film combined with intra-oral X-ray films as required. The reaction chambers and reservoirs are to be constructed of a chemically inert material such as plastic, stainless steel, or the like, to prevent severe corrosion that would be caused by developer and fixer chemicals, and are fluidly sealed to hold a quantity of water and chemical.

The developer storage reservoir and fixer storage reservoir fluidly communicate via respective feed lines or conduits to each of a plurality of reaction chambers, thereby allowing the flow of chemicals from developer storage and fixer storage reservoirs to reaction chambers and back. Disposed between each feed line and reaction chamber is a manifold with valves utilized for the organized and sequential flow of water and chemicals into and out of the reaction chambers. Each manifold has mounted thereon developer, fixer, and drain valves. The developer and fixer valves are operable to selectively place a respective developer or fixer storage reservoir in fluid communication with each of the reaction chambers. Preferably, each of the feed lines with manifold and valves connecting the developer storage reservoir and fixer storage reservoir to each reaction chamber are fluidly coupled to a point adjacent to the lower surface of the reaction chambers. Fluidly coupled to and extending from each reaction chamber manifold adjacent to the lower surface thereof is a drain line, which includes said drain valve coupled therein for selectively opening and closing each drain line. Each reaction chamber manifold further includes one or more water filler hoses fluidly coupled thereto which are connected to an incoming water source and used to selectively fill each reaction chamber with water, thereby rinsing each reaction chamber and the X-ray films therein.

Additionally, each feed line is configured so that it is in communication with one or more selected first force means which is capable of moving chemical from the developer storage reservoir and fixer storage reservoir into each reaction chamber. The selected first force means may be one or more means of the group consisting of: a pump, air pressure, gravitational force, and vacuum. Further, each feed line is configured so that it is in communication with a selected second force means, which is capable, of moving chemical back into the developer storage reservoir and fixer storage reservoir. The second force means may be one or more means of the group consisting of: a pump, air pressure, gravitational force, and vacuum. Also, fluidly coupled to each reaction chamber adjacent to the upper rim is an overflow line configured to prevent flooding if a malfunction of the water or developer or fixer valves occurs. The overflow pipe should have large enough lumen to rapidly drain off liquids and prevent overflowing for a long period of time should there be a valve failure. Additionally, each reaction chamber includes a duct disposed to allow the inflow of warm air from a heater/blower mechanism for the purpose of drying X-ray films once a final wash cycle is completed.

In accordance with the preferred embodiment, the front walls of the reaction chambers are oriented in a manner complimentary to the shape of the intra-oral X-ray film cassettes and/or larger extra-oral X-ray film rack. Additionally, the distance separating the front and back walls of the reaction chambers (i.e., the width of the side walls) is dimensioned so as to slightly exceed the width of the film-holding cassettes and films, and no more, the purpose being to utilize the least amount of chemical possible. Further, the height of the reaction chambers should be just enough to allow a thorough submerging of the X-ray films (at least ½ to 1 inch) plus an additional height that will resist the overflow of chemicals or water. Further, the height of the reaction chamber should be sufficient to allow for the placement of the overflow pipe above the maximum height of the water level in the reaction chamber. Configured adjacent to the upper rim of each reaction chamber is a water sensor, capable of signaling a controller that water has reached said water sensor. X-ray film cassettes and large film holders are configured to be attachable or supportable by the rim of each reaction chamber so that the X-ray films do not touch the chamber bottom or sides during processing. In this respect the upper part of the film holding cassettes and large film holder is supported by the upper rim of the reaction chambers so that X-ray films will be totally immersed in chemistry solutions sequentially applied therein. Additionally, there is configured an electronic controller with keypad, electronically coupled with all electric control devices, valves, dryers, and the like, related to the automated static X-ray film processor. Said electronic controller being capable of selectively operating said electric control devices in a pre-programmed manner that will allow for the processing of X-ray films in reaction chamber therein. For the purposes of this writing, the term primary cycle will denote a cycle in any reaction tank that is started ahead of all other cycles in operation. A secondary cycle will be a processing cycle that is started after the start of a primary cycle. Additionally, when the terms "films" or "set of films" are utilized, they shall denote one or a plurality of individual films.

In operation of the automated static X-ray film processor of the present invention, a primary operator exposes a set of X-ray films on a patient in an operatory. The exposed X-ray films are taken to a darkroom, or placed in a daylight-loading device attached to the processor, where they are uncovered then mounted on a film holding device or cassette. The films with cassettes are then placed in an available reaction chamber. The lid of the reaction chamber is closed, and the start key for that chamber is pressed on the electronic controller panel. As soon as the primary cycle commences in the chosen reaction chamber, a secondary operator who has already exposed X-ray films on another patient may now uncover the X-ray films and place them in an available secondary reaction chamber, and press the associated start key. The second set of films will remain in waiting in the secondary reaction chamber until the fixer chemical portion of the primary cycle in the primary reaction chamber is complete, making chemicals available for the secondary cycle. The secondary cycle will commence in the secondary reaction chamber as soon as the fixer chemical is returned to the fixer storage reservoir from the primary reaction chamber. Or, if the fixer portion of the primary cycle is complete and the set of X-ray films in the primary reaction chamber is in final washing and drying, the secondary cycle may start immediately in the secondary reaction chamber.

In the preferred embodiment, the developing cycle in the primary reaction chamber proceeds as follows: the valve disposed between the developer storage reservoir and the primary reaction chamber is electronically opened via the electronic controller and first force means is activated which forces developer chemical to flow into the primary is reaction chamber and begin the developing process. Once the X-ray films are properly developed, an electronic signal is sent via the electronic controller which causes developer chemical to return to the developer storage reservoir via second force means. The associated developer valve is signaled to close via the electronic controller, trapping the developer chemical therein. A water wash is then initiated. The water valve associated with the primary reaction chamber is signaled to open via the electronic controller, which fills the primary reaction chamber with water. Water inflow is terminated when it reaches the water sensor in close proximity to the top of the primary reaction chamber. The water sensor is configured above the highest level that chemicals reach to insure a thorough removal of remnant chemical. Additionally, the water sensor is configured so that the X-ray films therein are thoroughly submerged with water so that a complete wash is accomplished. Once water touches the water sensor, the associated primary reaction chamber water valve is electronically signaled to close via the electronic controller, and the associated drain valve is electronically opened. Wash water is thereby drained from the primary reaction chamber. Once all wash water is removed from the primary reaction chamber, the associated drain valve is signaled to close via the electronic controller. Next, the valve disposed between the fixer storage reservoir and the primary reaction chamber is electronically signaled to open via the electronic controller and a first force means is activated which forces fixer chemical to flow into the primary reaction chamber and begin the fixing process. Once the X-ray film is property fixed, the electronic controller signals, causing the fixer chemical to return to the fixer storage reservoir via second force means and the associated valve is closed, trapping the fixer chemical therein. At this time in the primary cycle, chemicals are available for use in the secondary reaction chamber, and a processing cycle in the secondary reaction chamber may commence.

X-ray films in the primary reaction chamber are now washed, as described above. A drying function initiated by the electronic controller now commences, whereat warm air is blown on the X-ray films from a blower and heater coil mechanism. Once the X-ray films are dried, the primary processing cycle is completed. The X-ray films are removed from the primary reaction chamber, another set of exposed X-ray films may be placed therein, and another developing cycle begun while X-ray films are processing in the secondary (now primary) reaction chamber; and on and on. Processing proceeds in the new primary reaction chamber in the same manner as described above for the previous primary reaction chamber.

BRIEF DESCRIPTION OF THE DRAWINGS

These as well as other features of the present invention will become more apparent upon reference to the drawings wherein.

DETAILED DESCRIPTION OF THE PREFERRED EMBODIMENT

Refer now to the drawings wherein the showings are for the purposes of illustrating a preferred embodiment of the present invention only and not for the purposes of limiting the same.

Figure 1:
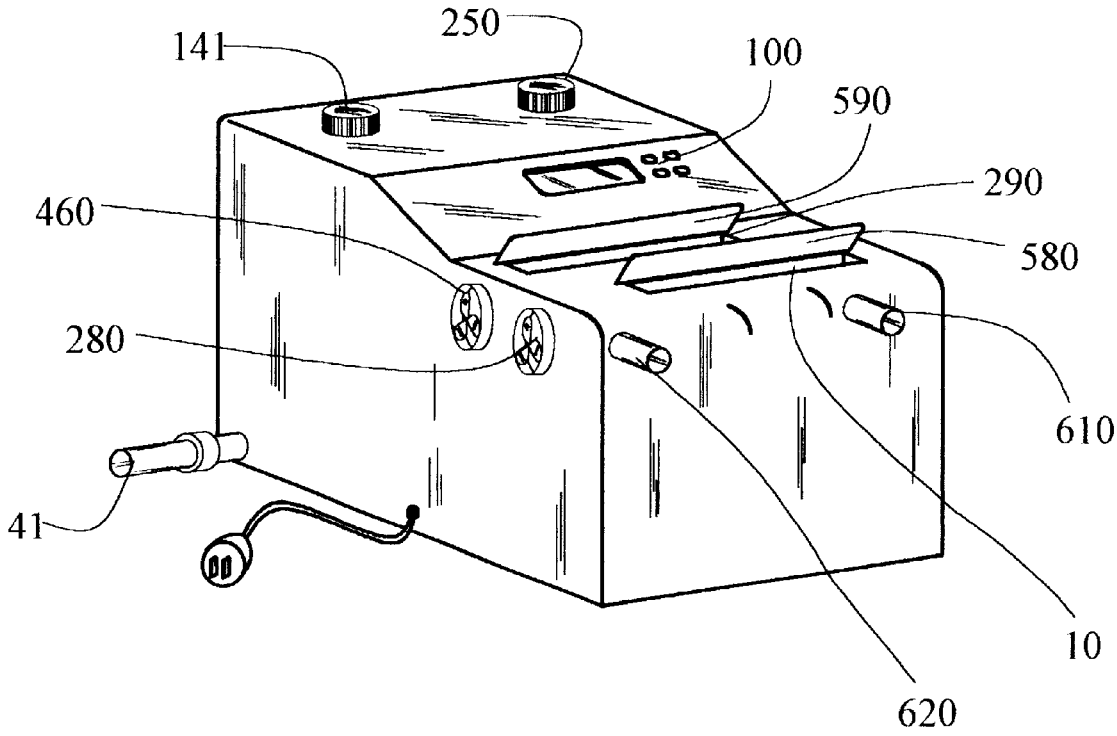
FIG. 1 is a front perspective view of the automated static X-ray film processor with chassis cover.

Refer to FIG. 1, which is a front view of the automated static X-ray film processor with chassis cover. Reaction chambers 1 (10) and 2 (290) have lids (580) and (590) respectively, which provide light protection during processing cycles. Overflow pipes (610) and (620) are configured so that if water valve or chemical valve malfunctions occur, liquid will drain down said overflow pipes rather than flooding the processor and/or countertop. Control panel (100) is utilized by the operator to start and monitor processing cycles. Drainpipe (41) is the confluence of drainpipes emanating from each reaction chamber. Heater blowers and ducts (280) and (460) are configured to dry X-ray films within said reaction chambers 1 and 2. Developer storage reservoir lid (141) and fixer storage reservoir lid (250) seal the openings into developer and fixer storage reservoirs, respectively during use. Further, said storage reservoir lids provide access to the storage tank reservoirs for refilling and replenishing.

Figure 2:
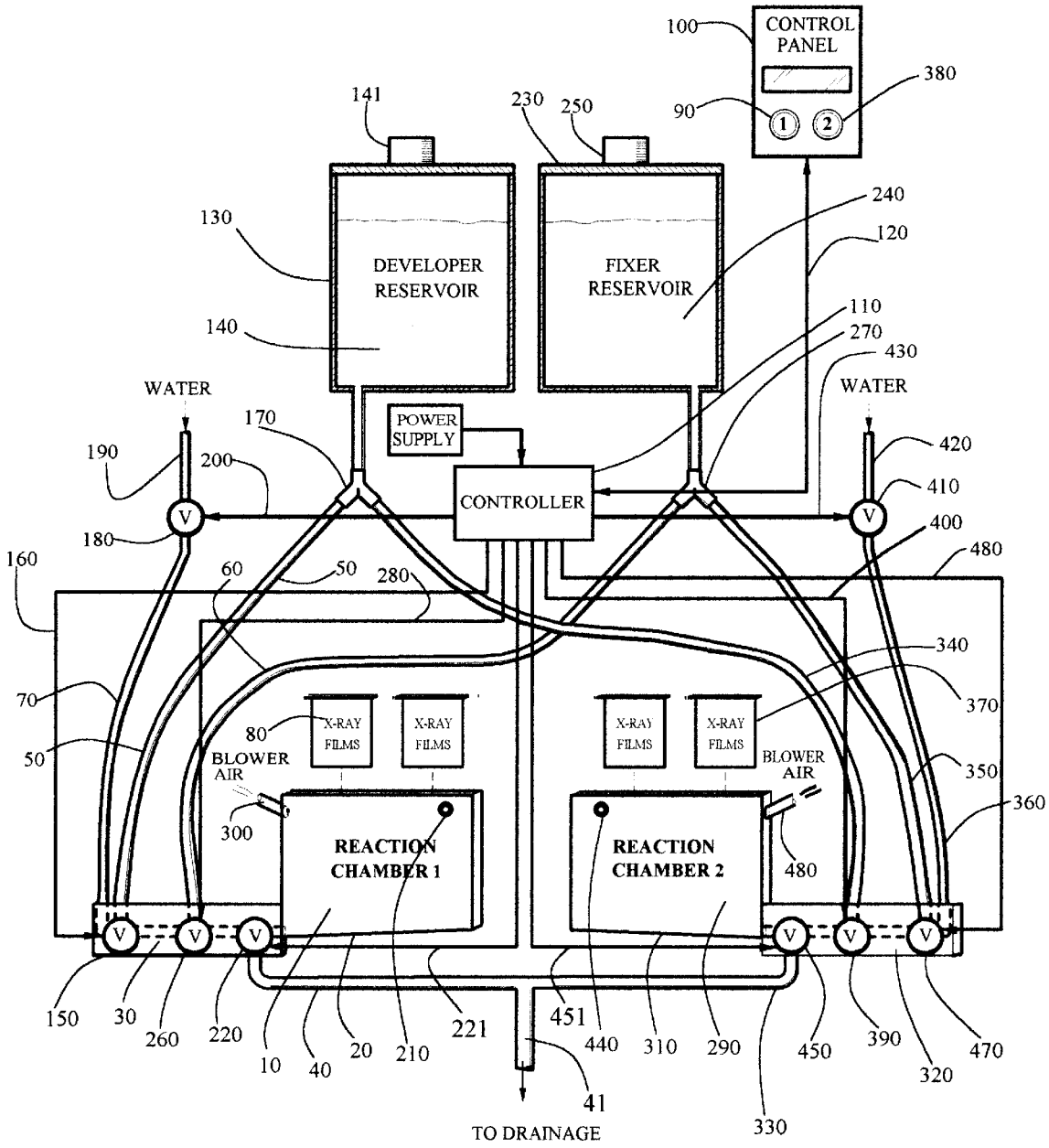
FIG. 2 is a schematic diagram of workings of the present invention.

Now refer to FIG. 2 for a detailed description of the operation of the automated static X-ray film processor. In FIG. 2 there is configured one developer storage reservoir (130), one fixer storage reservoir (230), and reaction chambers (10) and (290). Chemicals will move from the developer and fixer storage reservoirs to the reaction chambers and back in previously determined orderly and timed cycles so that X-ray films within said reaction chambers (10) and (290) will be properly processed. A variety of force means may be utilized to accomplish this fluid movement chosen from one or more force means of the group consisting of: pump, vacuum, gravity, and air pressure. For the purpose of this writing, force means that forces chemical into said reaction chambers from developer and fixer storage reservoirs shall be denoted first force means. Force means that returns chemical to said developer and fixer storage reservoirs from said reaction chambers shall be denoted second force means.

In FIG. 2, there is configured a reaction chamber 1 (10) sized to accept the placement within of various sizes of X-ray films with holders. Said reaction chamber 1 comprises a front, back, and two side walls, and a bottom section having a drain slope (20) so that liquid within can flow toward manifold 1 (30). Manifold 1 acts as the confluence of drain valve 1 (220) and hose (40), developer valve 1 (150) and hose (50), fixer valve 1 (260) and hose (60), and water hose (70). Manifold 1 is further configured so that the opening of any of the valves individually will allow the free flow of water, developer, or fixer chemical into and out of reaction chamber 1 without affecting or being affected by the remaining closed valves and liquids. To start a primary developing cycle in reaction chamber 1 (10), a primary operator uncovers a previously exposed set of X-ray films in a darkroom or daylight loading device, then places said X-ray films on a film holding cassette, then places said X-ray films with holder (80) into said reaction chamber 1 (10). The primary operator then presses key 1 (90) on control panel (100). Control panel (100) is electronically coupled with controller (110) via cable (120). An electronic signal is sent to controller (110) via cable (120), which starts the developing cycle in reaction chamber 1. At this time, a secondary operator may place an exposed set of X-ray films in reaction chamber 2, and press start key 2 (380). Said set of X-ray films will remain in waiting in said reaction chamber 2 until chemicals are available from said primary cycle in reaction chamber 1.

There is configured a developer storage reservoir (130) with a front, back, two sides, bottom, and a top, fluidly sealed, with developer solution (140) inside. Said developer storage reservoir is further configured with a means for filling and removing chemical, a lid (141) or the like. Said developer storage reservoir is fluidly coupled to developer valve 1 (150) through hose (50). Once start key 1 (90) has been pressed, an electronic signal is sent to controller (110) which in turn signals, via cable (160), developer valve 1 (150) to open and first force means to function. Developer chemical (140) flows through wye (170), hose (50), manifold (30), developer valve 1, (150) and into reaction chamber 1 (10). Flow of developer chemical into said reaction chamber 1 must continue until said X-ray films are well submerged with solution. X-ray films and cassette (80) immersed in developer chemical for a designated period of time. Images are now formed on said X-ray films which are still light sensitive and can be damaged by light. Second force means is next activated by controller (110) so that said developer chemical flows from reaction chamber 1 (10) back into developer storage reservoir (130) via hose (50), and wye (170). When all developer chemical is returned to developer storage reservoir (130), controller (110) electronically closes valve (150) and terminates second force means, sealing said developer chemical inside said developer storage reservoir. At this time, the developer portion of the primary cycle in reaction chamber 1 is complete.

A water wash of reaction chamber 1 is now initiated. In the preferred embodiment, water valve 1 (180) is connected to an external water source by hose (190) and is fluidly connected to manifold 1 by hose (70). Controller (110) sends a signal via cable (200) to water valve 1 (180), which opens said water valve 1 and causes water to flow into reaction chamber 1 (10). Said reaction chamber 1 is configured with water sensor 1 (210) positioned so that it is adjacent to the upper rim and above the highest level of the chemicals that flow therein. Water sensor 1 (210) is electronically coupled to controller (110). When wash water from water valve 1 (180) reaches water sensor 1 (210), a signal is sent to controller (110), which causes water valve 1 (180) to shut off. Controller (110) now opens drain valve 1 (220) via electronic coupler (221), causing water to drain through manifold 1 (30), drain valve 1 (220), and drain hose (40) to external drainage. The purpose of the wash cycle is to remove all developer chemical residue from said X-ray films (80) and said reaction chamber 1, thereby stopping the developing of said X-ray films. Additionally, cross contamination of developer and fixer chemicals is prevented by a thorough washing of said reaction chamber 1. Once reaction chamber 1 (10) has been thoroughly washed, as described above, and drain valve 1 (220) has been closed by an electronic signal from controller (110), reaction chamber 1 is now ready for the fixer portion of said primary cycle.

There is configured fixer storage reservoir (230) comprising a front, back, two sides, a bottom, and a top, fluidly sealed, filled with a quantity of fixer solution (240). Said fixer storage reservoir is further provided with a means for adding and removing chemical, a lid (250) or the like. Said fixer storage reservoir is fluidly coupled to said reaction chamber 1 via manifold 1 (30), fixer valve 1 (260) hose (60), and wye (270). Fixer valve 1 (260) is electronically coupled to controller (110) via cable (280). Controller (110) next signals fixer valve 1 (260) to open via cable (280), and first force means to activate, causing fixer chemical (240) to flow through wye (270), hose (60), manifold 1 (30) and into reaction chamber 1 (10). Flow of said fixer chemical continues until the inserted set of X-ray films on cassette (80) is completely submerged. Fixer chemical converts each image on said X-ray films previously bathed in developer chemical into a negative, and permanently fixes the images so that the images cannot be damaged by light. Fixer chemical remains in reaction chamber 1 (10) until said X-ray films are completely fixed. Second force means is then activated by controller (110) so that said fixer chemical will flow from reaction chamber 1 (10) back into fixer storage reservoir (230) via hose (60), and wye (270). When all fixer chemical is returned to fixer storage reservoir (230), controller (110) causes the closure of fixer valve 1 (260) and terminates second force means, sealing said fixer within said fixer storage reservoir (230). The chemical portion of the primary cycle in reaction chamber 1 is now complete. In the preferred embodiment, at this time in the primary cycle, developer and fixer chemicals are available to start a secondary cycle in reaction chamber 2 (290). Said set of X-ray films previously placed in reaction chamber 2 may now commence processing while washing and drying are accomplished in reaction chamber 1.

To finish the processing cycle in reaction chamber 1, X-ray films (80) are water washed as described above. Warm air from a heater/blower mechanism is next directed at said set of X-ray films through blower air duct 1 (300) which accomplishes drying. Once dry, said set of X-ray films is ready for removal, mounting, and diagnosis. Reaction chamber 1 (10) is now available to process another set of films.

There is configured reaction chamber 2 (290), sized to accept the placement within of various sizes of X-ray films with holders. Said reaction chamber 2 (290) comprises a front, back, and two side walls, and a bottom section having a drain slope (310) so that liquid within can flow toward drain manifold 2 (320). Mountings, within the automated static X-ray film processor, of reaction chamber 1 (10) and reaction chamber 2 (290) are offset horizontally and configured so that there is room for hoses, manifolds, and other needed plumbing to be attached to the drain opening of each said reaction chamber. Manifold 2 (320) acts as the confluence of drain valve 2 (450) and its hose (330), developer valve 2 (390) and its hose (340), fixer valve 2 (470) and its hose (350), and water hose (360). Manifold 2 is further configured so that the opening of any of the valves individually will allow the free flow of water or developer or fixer chemical into and out of reaction chamber 2 without affecting or being affected by the remaining non-operative valves and liquids.

To start a secondary developing cycle in reaction chamber 2 (290), a secondary operator has placed a previously exposed and uncovered set of X-ray films (370) within, and pressed key 2 (380) on control panel (100), which may be done during the processing of X-ray films in reaction chamber 1. If chemicals are not being utilized in a primary processing cycle in reaction chamber 1, (10), an electronic signal is sent to controller (110) via cable (120) which initiates said secondary developing cycle in said reaction is chamber 2. Controller (110) next signals developer valve 2 (390) to open via cable (400), and first force means to activate. Developer chemical flows through wye (170), hose(340), manifold 2 (320),and into reaction chamber 2 (290). An exposed set of X-ray films may be placed in reaction chamber 1 (10) and start key 1 (90) pressed at this time if X-ray films in said reaction chamber 1 has completed processing and is removed. Flow of developer chemical (140) into reaction chamber 2 (290) will continue until said X-ray films within are well submerged with solution. X-ray films (370) are immersed in developer chemical for a designated period of time. An image is now formed on each of said X-ray films, which is still light-sensitive and can be damaged by light. Once the developer stage of said secondary cycle is completed, said second force means is activated electronically by controller (110), forcing developer solution to flow back into developer storage reservoir (130). When all developer chemical (140) is returned to developer storage reservoir (130), controller (110) acts to close developer valve 2 (390) and terminate second force means, sealing said developer in said developer storage reservoir (130).

A water wash of reaction tank 2 is next begun. In the preferred embodiment, water valve 2 (410) is connected to an external water source via hose (420). Controller (110) sends a signal via cable (430) to water valve 2 (410), which causes water to flow into reaction chamber 2 (290). Said reaction chamber 2 is configured with water sensor 2 (440) adjacent to the upper rim, and positioned so that the water sensor is above the highest level of the chemicals that flow therein. Water sensor 2 (440) is electronically coupled to controller (110). When wash water from water valve 2 (410) reaches water sensor 2 (440), a signal is sent to controller (110), which causes said water valve 2 to shut off. Controller (110) next electronically opens drain valve 2 (450) via electronic coupler (451), causing water to drain through manifold 2 (320), drain valve 2 (450), and drain hose (330), to combined drain hose (41), to external drainage. Once said reaction chamber 2 and X-ray films therein have been thoroughly washed, as described above, said reaction chamber 2 is ready for the fixer portion of said secondary cycle. Fixer storage reservoir (230) is fluidly connected to said reaction chamber 2 by manifold (320), fixer valve 2 (470), hose (350) and through wye (270). Fixer valve 2 (470) is electronically coupled to controller (110) via cable (480). Controller (110) signals said fixer valve 2 to open and first force means to activate via cable (480), causing fixer chemical (240) to flow through wye (270), hose (350), manifold 2 (320) and into reaction chamber 2 (290). Flow of fixer chemical continues until said X-ray films therein are completely submerged. Fixer chemical converts the images on X-ray films, which were previously immersed in developer chemical, into negatives. The fixer thusly permanently fixes the images on the developed X-ray films so that they cannot be damaged by light. Fixer chemical remains in reaction chamber 2 (290) for a designated period of time. Once fixing has been completed, second force means is next activated by controller (110) so that said fixer chemical will flow from reaction chamber 2 (290) back into fixer storage tank (230). Fixer valve 2 (470) is then electronically closed via controller (110), trapping fixer chemical therein. X-ray films may now commence processing in reaction chamber 1 while said secondary cycle (now primary) in reaction chamber 2 is continuing. In this fashion, cycles may continually be run in overlapping succession, alternating between chambers 1 and 2. A wash cycle next commences in reaction chamber 2 as described above. Controller (110) then operates a heater/blower mechanism, forcing warm air through duct (480), which dries said X-ray films. Said X-ray films are now removed from reaction chamber 2, making reaction chamber 2 available for a new processing cycle.

Figure 3:
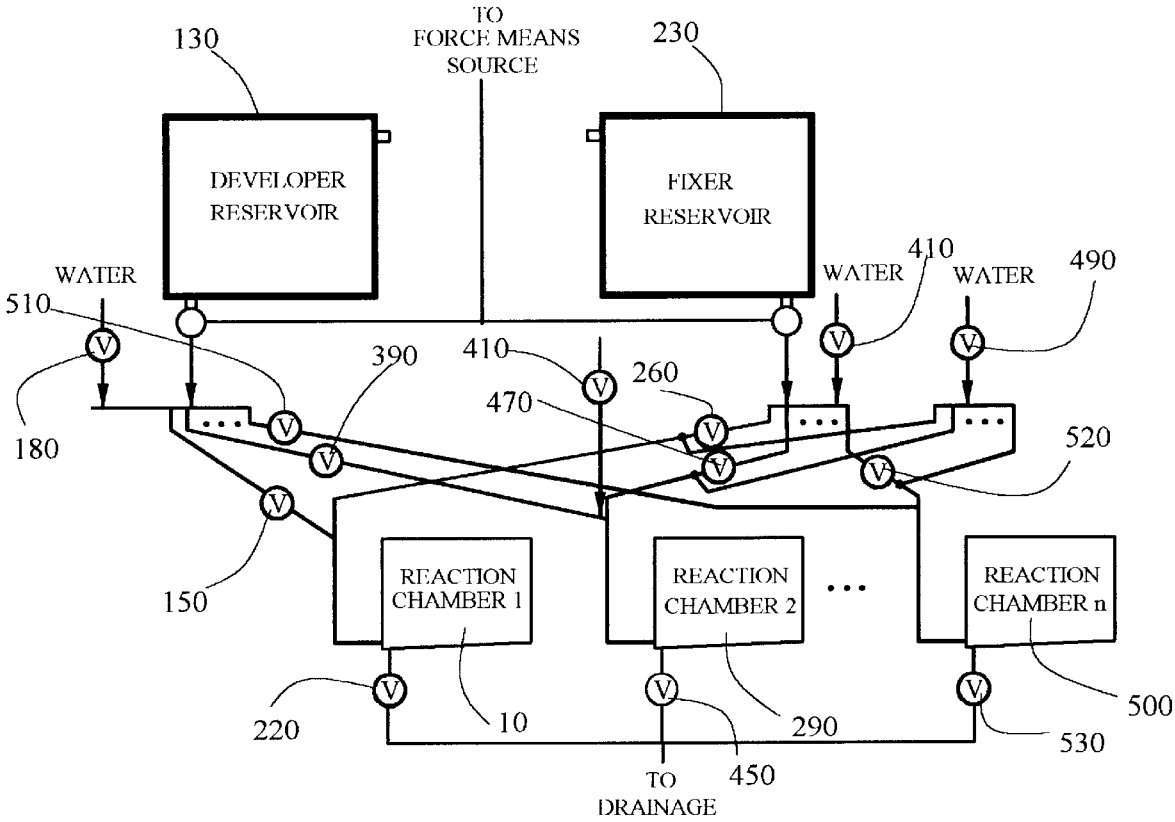
FIG. 3 is a schematic diagram showing how the present invention would be configured if there were more than two reaction chambers.

Now refer to FIG. 3, which demonstrates that more than two reaction chambers may be utilized in alternative embodiments of this novel design. In this drawing, additional reaction chambers more than the two above described shall be denoted with the single letter n, where n=the number of reaction chambers more the than two above described required to run n additional concurrent but staggered cycles. As shown in previous drawings, there is provided developer storage reservoir (130) and fixer storage reservoir (230). Said developer storage reservoir is fluidly coupled to reaction chamber 1 (10), by developer valve 1 (150) and its hose. Said fixer storage reservoir (230) is fluidly coupled to reaction chamber 1 (10) by fixer valve 1 (260) and its hose. Further, developer storage reservoir (130) is fluidly coupled to reaction chamber 2 (290) by developer valve 2 (390) and its hose. Fixer storage reservoir (230) is fluidly coupled to said reaction chamber 2 by fixer valve 2 (470) and its hose. Further, there is provided reaction chambers n (500). Said-reaction chambers n (500) are fluidly coupled to developer storage reservoir (130) through developer valves n (510) and their hoses. Additionally, reaction chambers n (500) are fluidly coupled to fixer storage reservoir (230) through fixer valves n (520) and their hoses. Water valve 1 (180) supplies reaction chamber 1, water valve 2 (410) supplies reaction chamber 2, and water valves n (490) supply reaction chambers n. Said water valves (180), (410), and (490) are coupled to an external water source, and when activated will wash their respective reaction chambers. Wash water will drain through drain valve 1 (220) for reaction chamber 1, drain valve 2 (450) for reaction chamber 2, and drain valves n (530) for reaction chambers n. Each reaction chamber will have its own heater/blower mechanism which will dry processed X-ray films.

Figure 4:
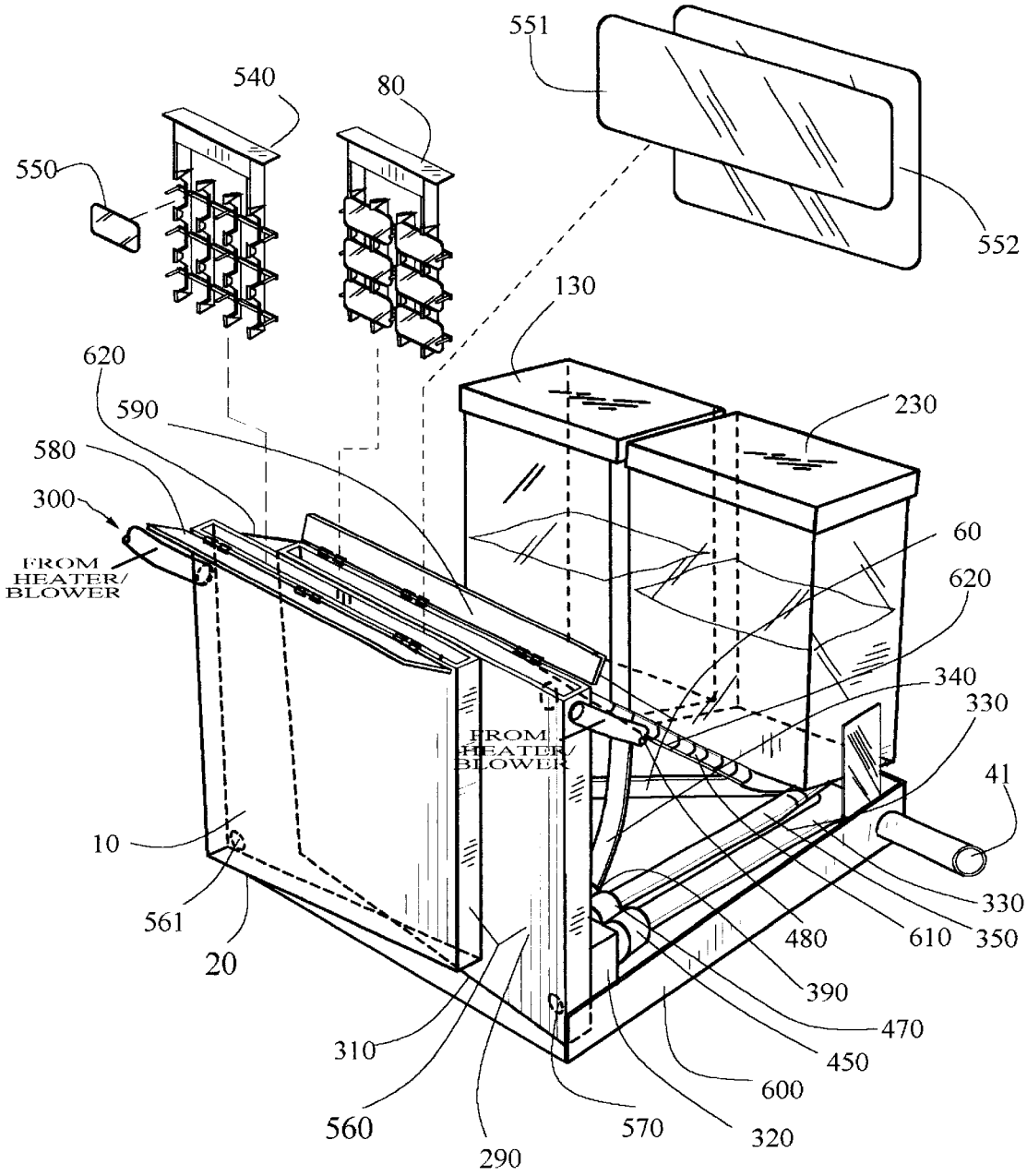
FIG. 4 is an uncovered perspective view of the preferred embodiment showing reaction chambers and chemical storage reservoirs.

Now refer to FIG. 4, which demonstrates how the developer and fixer storage reservoirs and reaction chambers are configured, and how X-ray films are placed into processor reaction chambers. In the preferred embodiment, there is provided film cassette (540), configured to hold a previously exposed set of X-ray films (550). In the preferred embodiment, reaction chamber 1 (10) and reaction chamber 2 (290) are sized and configured to hold three six-film to eight-film cassettes each, totaling eighteen to twenty-four 24 intra-oral dental X-ray films. Additionally, said reaction chambers 1 and 2 are also sized to hold extra-oral film of sizes 12"×6" (551), and 8"×10" (552). In the case of medical film processing, said reaction chambers may also be sized to hold any size X-ray film desired by the user.

In the preferred embodiment, said reaction chambers 1 and 2 are offset (560), which allows tubing, valves, and a manifolds to be attached to the lower side facing the developer and fixer storage reservoirs where they are accessible to the drain hoses and to hoses from said developer and fixer storage reservoirs. Said reaction chambers 1 and 2 bottoms are configured at an angle (20) and (310) so that liquid inside will flow to drain openings (561) and (570) respectively. In the preferred embodiment, the reaction chamber manifolds are positioned on opposite sides of the processor, the purpose being to allow room for tubing, plumbing, and valves.

In a darkroom or daylight-loader, a primary operator uncovers and places a previously exposed set of X-ray films (550) on film cassettes (540). Said film cassettes are then placed in reaction chamber 1 (10) for processing. Reaction chamber 1 lid (580) is then closed to keep said X-ray films from being light exposed during processing. Start key 1 on the control panel is pressed which starts the processing cycle in said reaction chamber 1. Once the set of X-ray films in said reaction chamber 1 is processing, a secondary operator will be able to place an additional set of films in reaction chamber 2 (290) in the same manner. Reaction chamber 2 lid (590) is then closed and start key 2 on the control panel is pressed. X-ray films can then be processed in both chambers at the same time; of course reaction chamber 1 cycle would precede the cycle in reaction chamber 2. Once reaction chamber 1 film is finished, that chamber will be available for a secondary cycle. Also shown in FIG. 4 are developer storage reservoir (130) and fixer storage reservoir (230), and processor base (600). Additionally, reaction chambers 1 and 2 are provided with overflow pipes (610) and (620) which will prevent flooding in case of malfunction of the water or chemical valves.

Figure 5A:
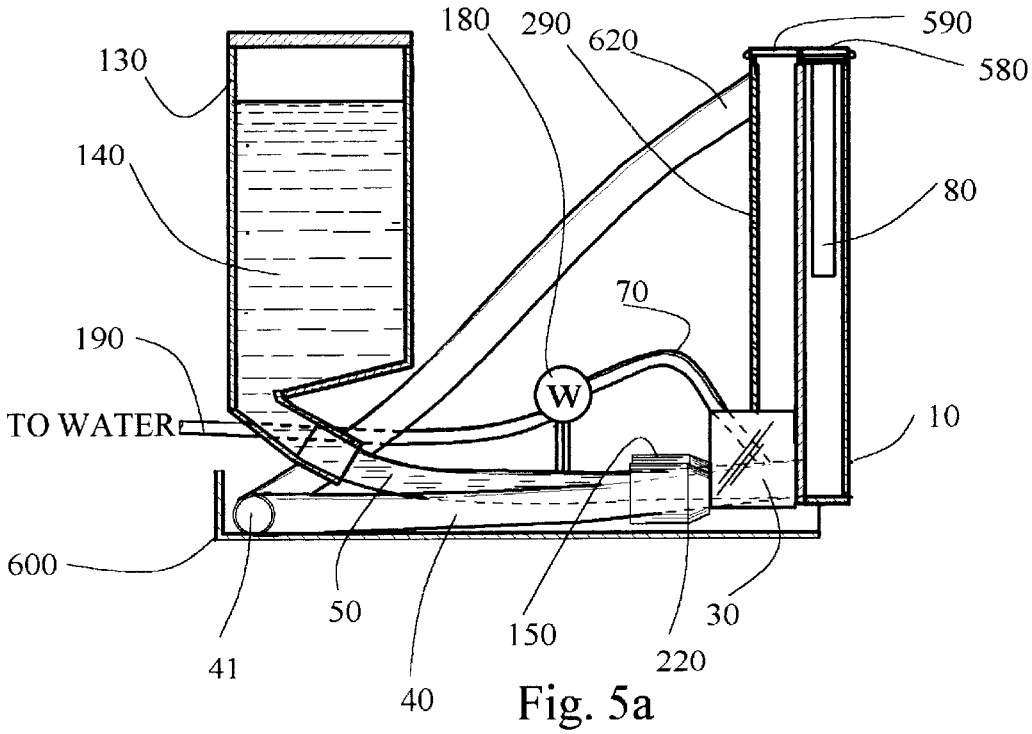
FIGS. 5*a*, 5*b*, and 5*c* are side views showing chemical moving from the developer storage reservoir to primary and secondary reaction chambers in separate cycles.
Figure 5B:
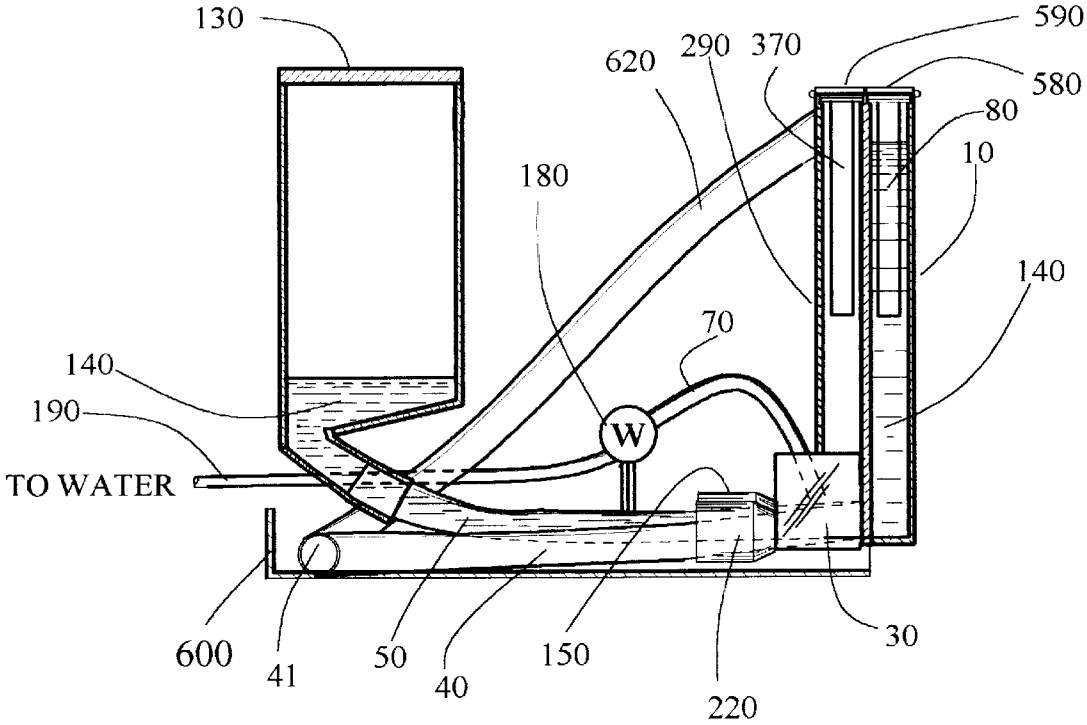
Figure 5C:
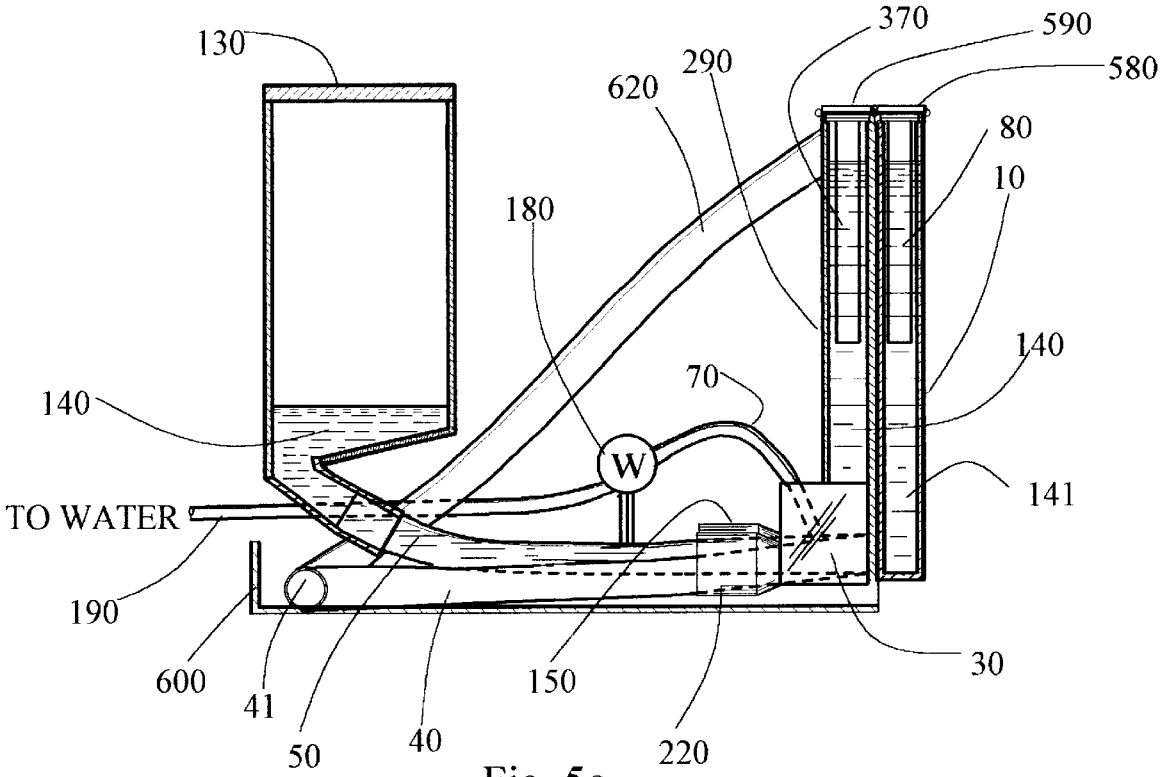

Refer now to FIGS. 5*a*, 5*b*, and 5*c*, which demonstrate how, in the preferred embodiment, developing solutions, flow into and out of reaction chambers during a primary and secondary cycle. For clarity, only the left side of the preferred embodiment is shown. Referring to FIG. 5*a*, there is provided developer storage reservoir (130) filled with developer chemical (140). Said developer storage reservoir is fluidly coupled to reaction chamber 1 (10) via manifold (30), developer valve 1 (150), and its hose (50). A primary operator, in a darkroom or daylight loader, uncovers a previously exposed set of X-ray films, then places said X-ray films on cassette (80). Said X-ray films with cassette are placed in reaction chamber 1 (10). Reaction chamber 1 lid (580) is closed. The primary operator then presses start key 1 on the control panel. A processing cycle commences with the opening of developer valve 1 (150) and activation of first force means. Developer chemical (140) flows into said reaction chamber 1.

Now, referring to FIG. 5*b*, developer solution (140) has filled reaction chamber 1 (10) via first force means. Flow will continue into said reaction chamber 1 until X-ray films therein are completely submerged in solution. Once the developer portion of the cycle is completed, developer solution is returned to said developer storage reservoir by activation of second force means. As soon as all developer solution is completely in developer storage reservoir (130 ), said developer valve 1 is electronically signaled to close, and second force means is terminated, trapping all developer solution within, as shown in FIG. 5*a*.

Following the fixer portion of said the primary cycle, developer chemicals are available for use in reaction chamber 2. A secondary operator uncovers a previously exposed set of X-ray films and places said X-ray films on cassette (370). Said cassette with X-ray films is placed into said reaction chamber 2, and lid (590) is closed. The secondary operator then presses start key 2 on control panel (60) which begins a secondary cycle in reaction chamber 2. Said secondary cycle runs while said primary cycle in reaction chamber 1 is continuing. Referring to FIG. 5*c*, X-ray films in reaction chamber 1 are being washed with wash water (141) from water valve (180), as X-ray films in reaction chamber 2 are developing. Liquid shown in reaction chamber 2 (290) is developer chemical (140) from developer storage reservoir (130). After a wash cycle, fixer chemical is flowed into reaction chamber 2 (10) in the same manner as discussed above, and then the X-ray films within are again washed and then dried. Once processed X-ray films in reaction chamber 1 (10) are removed, said reaction chamber 1 is ready for another set of films. Said secondary cycle in reaction chamber 2 continues on to completion; and on and on.

Figure 6A:
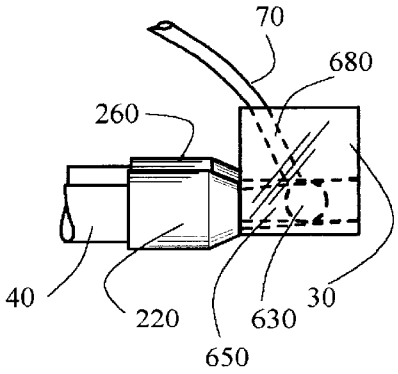
FIGS. 6*a* and *b* are the showing of a manifold of the preferred embodiment.
Figure 6B:
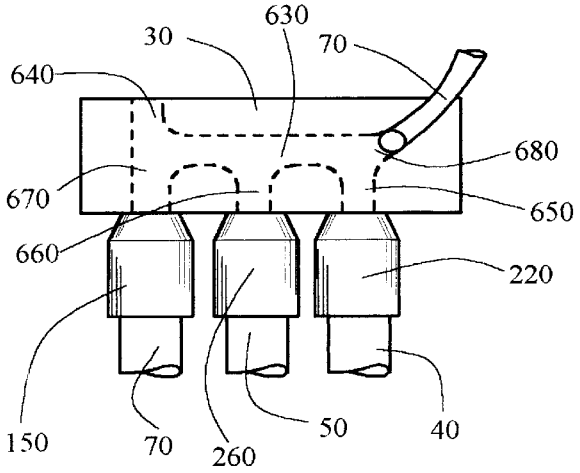

Now refer to FIGS. 6*a* and *b*, included for the showing of how, in the preferred embodiment, the manifold is configured. In FIG. 6*a*, a side view of block manifold (30) is shown. Drain aperture (650) allows water to flow toward drain valve (220) and to drain hose (40). Note the downward orientation of said drain aperture, which allows for the flow of liquid into drain hose (40). Water aperture (680) is fed by water hose (70) and is configured so that wash water will flow into all internal areas of said manifold. FIG. 6*b* shows apertures into all valves from the drain of reaction chamber 1. In the preferred embodiment, main manifold aperture (640) of manifold (30) is lined up exactly with the corresponding drain aperture of reaction chamber 1. A mirror image manifold would of course be utilized for reaction chamber 2. Drain aperture (650) fluidly couples drain valve 1 (220) with the reaction chamber 1 drain aperture through manifold apertures (630) and (640). Manifold aperture (660) fluidly couples fixer valve 1 (260) with said reaction chamber 1 drain aperture through manifold apertures (630) and (640). Manifold aperture (670) fluidly couples developer valve 1 (150) with said reaction chamber 1 through said developer valve 1 manifold apertures (630) and (640).

Figure 7:
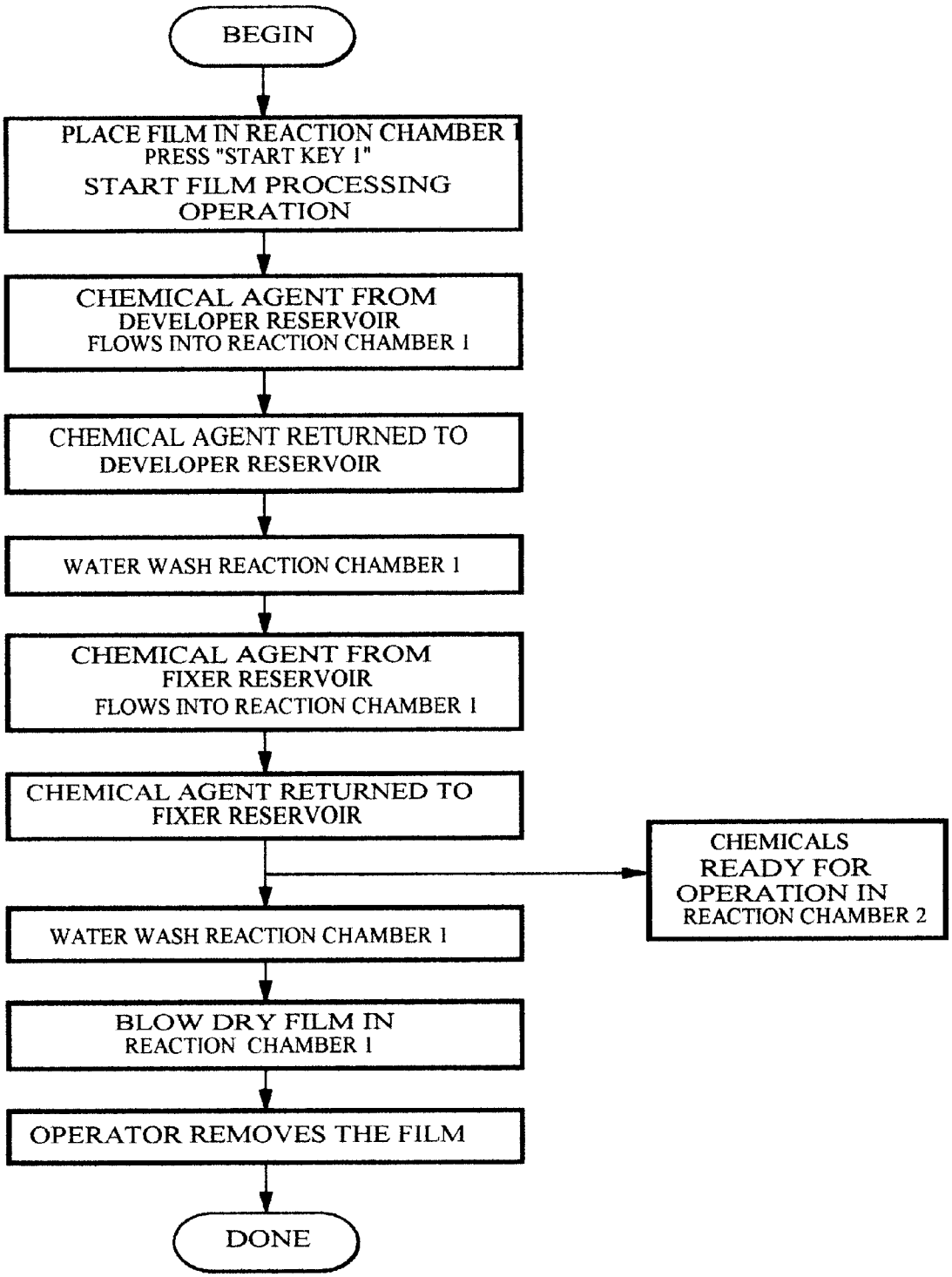
FIG. 7 and FIG. 8 Care schematic diagrams of how the cycles would operate in each reaction chamber of the present invention.
Figure 8:
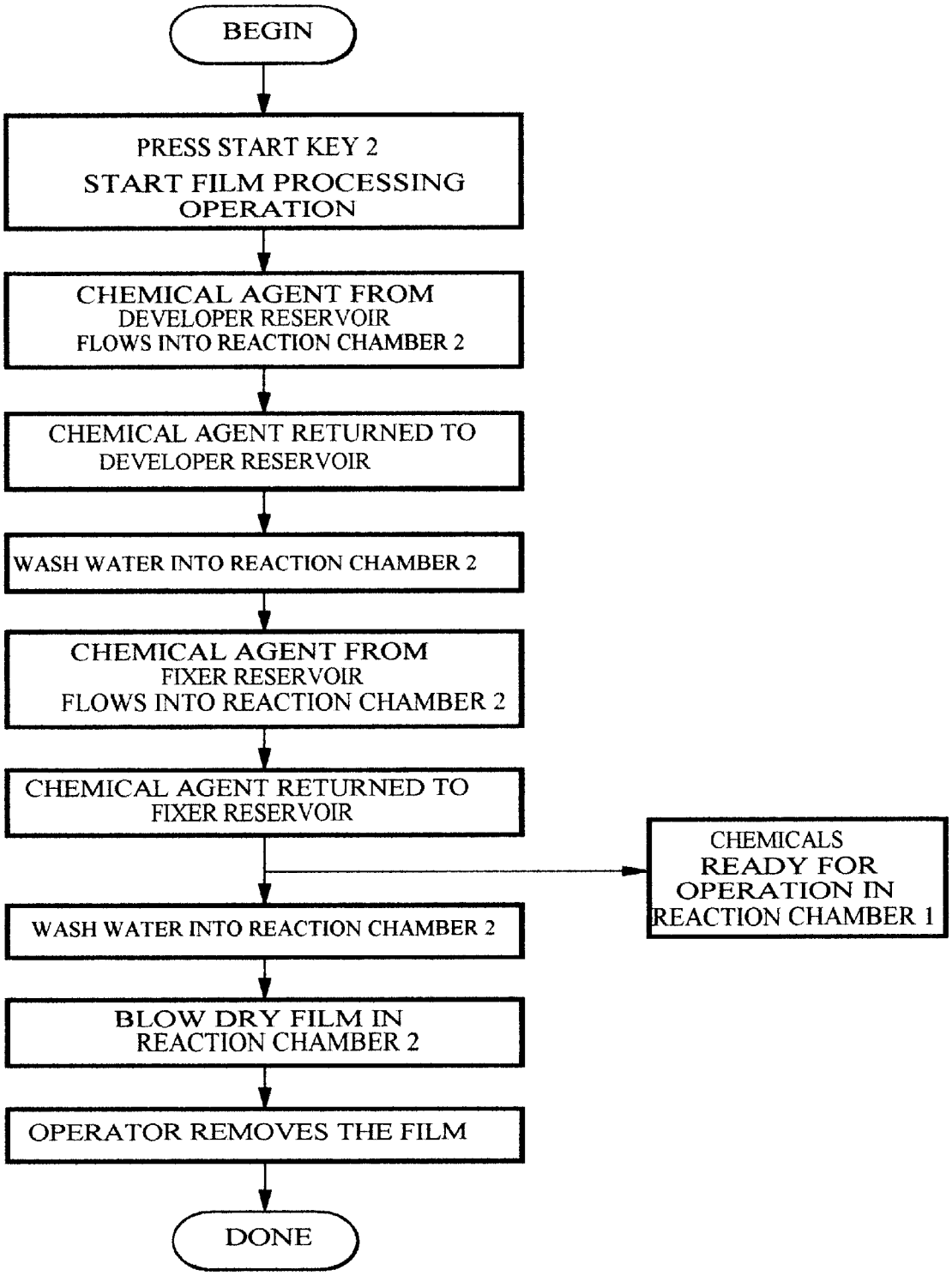

Now, refer to FIGS. 7 and 8, which are block diagrams for the showing of how processing cycles function, and for the showing of when chemicals will be available for a secondary processing cycle when a set of X-ray films are cycling in a primary reaction chamber. FIG. 7 displays the developing cycle in reaction chamber 1. Note that chemicals will be available for use in reaction chamber 2 after fixer chemical is returned to the fixer storage reservoir from reaction chamber 1. Additionally, when a set of X-ray films are processing in reaction chamber 2, chemicals will be available for use in reaction chamber 1 after fixer chemical is returned to the fixer storage reservoir from said reaction chamber 2, as shown in FIG. 8.

Additional modifications and improvements of the present invention may also be apparent to those skilled in the art. Thus, the particular combination of parts described and illustrated herein is intended to represent only one embodiment of the invention and is not intended to serve as limitations of alternative devices within the spirit and scope of the invention.

What is claimed is:

1. An automated static X-ray film processor configured with a plurality of reaction chambers, making said automated static film processor capable of processing X-ray film in a primary reaction chamber while at the same time allowing for additional processing cycles to run in one or a plurality of additional reaction chambers while said primary cycle is running, comprising:

(A) a developer storage reservoir for storing a quantity of a developer agent;

(B) a fixer storage reservoir for storing a quantity of a fixative agent;

(C) a first reaction chamber sized and configured to receive at least one previously exposed X-ray film and holder, said first reaction chamber defining a front, back, and two side walls, an upper rim, and lower surface, positioned so that said first reaction chamber can accept a feed line from said developer storage reservoir, said fixers storage reservoir, and an external drain;

(D) a second reaction chamber, sized and configured to receive at least one previously exposed X-ray film and holder, said second reaction chamber defining a front, back, and two side walls, an upper rim, and lower surface, positioned so that said second reaction chamber can accept a feed line from said developer storage reservoir, said fixer storage reservoir, and an external drain;

(E) n reaction chambers, the letter n representing the number of additional reaction chambers more than two required to run n additional successive overlapping cycles, said n reaction chambers each sized and configured to receive at least one previously exposed X-ray film and holder, said n reaction chambers each defining a front, back, and two side walls, an upper rim, and lower surface, positioned so that each said n reaction chamber can accept a feed line from said developer storage reservoir, said fixer storage reservoir, and an external drain;

(F) a first developer feed line and valve electronically coupled to an electronic controller for selectively opening and closing said first developer valve and feed line, connecting said developer storage reservoir to said first reaction chamber, placing said first reaction chamber in fluid communication with the developer agent stored within said developer storage reservoir;

(G) a second developer feed line and valve electronically coupled to said electronic controller for selectively opening and closing said second developer valve and feed line, connecting said developer storage reservoir to said second reaction chamber, placing said second reaction chamber in fluid communication with the developer agent stored within said developer storage reservoir;

(H) a first fixer feed line and valve electronically coupled to said electronic controller for selectively opening and closing said first fixer valve and feed line, connecting said fixer storage reservoir to said first reaction chamber, placing said first reaction chamber in fluid communication with the fixer agent stored within said fixer storage reservoir;

(I) a second fixer feed line and valve electronically coupled to said electronic controller for selectively opening and closing said second fixer valve and feed line, connecting said fixer storage reservoir to said second reaction chamber, placing said second reaction chamber in fluid communication with the fixer agent stored within said fixer storage reservoir;

(J) n feed lines and valves, electronically coupled to said electronic controller for selectively opening and closing said valves and feed lines connecting said developer storage reservoir to said n reaction chambers, placing said n reaction chambers in fluid communication with the developer agent stored within said developer storage reservoir;

(K) n feed lines and valves, electronically coupled to said electronic controller for selectively opening and closing said valves and feed lines, connecting said fixer storage reservoir to said n reaction chamber, placing said n reaction chambers in fluid communication with the fixer agent stored within said fixer storage reservoir;

(L) at least one water line for each first, second, and n reaction chamber, connected to a water source via a water valve which is electronically coupled to said electronic controller for selectively opening and closing said water valve, and fluidly coupled to each said first, second, and n reaction chamber;

(M) at least one drain line fluidly coupled to and extending from each said first, second, and n reaction chambers, each said drain line including a drain valve electronically coupled to said electronic controller for selectively opening and closing said drain line;

(N) a liquid transporting first force means wherein said first force means includes at least one means selected from the group consisting of a pump, air pressure, gravitational flow, and vacuum, coupled therein for selectively forcing the flow of developer and fixer solution through said feed lines from said developer storage reservoir and said fixer storage reservoir to said first, second, and n reaction chambers, operable upon selectively opening said developer feed line valves;

(O) a liquid transporting second force means wherein said second force means includes at least one selected means from the group consisting of a pump, air pressure, gravitational flow, and vacuum, coupled therein for selectively forcing the return of developer and fixer solutions through said feed lines from said first, second, and n reaction chambers to said developer storage reservoir and said fixer storage reservoir, followed by a closing of said feed line valves;

(P) said control means, operable to cause said automated static X-ray film processor to sequentially move through a series of processing cycles in a plurality of said reaction chambers wherein:

(a) a primary cycle is begun in said first reaction chamber wherein said control means opens said first developer valve while simultaneously maintaining said first fixer valve and said first drain valve in a closed position, activating said first force means causing the flow of developer solution into said first reaction chamber from said developer storage reservoir thereby submerging said exposed X-ray films in developer solution;

(b) a secondary cycle, which is run during said primary cycle, is begun in said second reaction chamber wherein said control means opens said second developer valve while simultaneously maintaining said first fixer valve and said first drain valve in a closed position, activating said first force means causing the flow of developer solution into said second reaction chamber from said developer storage reservoir thereby submerging said exposed X-ray film in developer solution;

(c) an n cycle, which is run during said primary and secondary cycles, is begun in said n reaction chamber wherein said control means opens said n developer valve while simultaneously maintaining said n fixer valve and said n drain valve in a closed position, activating said first force means causing the flow of developer solution into said n reaction chamber from said developer storage reservoir thereby submerging said exposed X-ray film in developer solution;

(d) said processing cycles of each first, second, or n reaction chamber continues individually to completion wherein:

once said X-ray films have been properly developed, said control means operates to activate said second force means and return said developer solution to said developer storage reservoir;

said control means operates to close said feed line valve and terminate said second force means, sealing developer solution in said developer storage reservoir;

said control means operates to open said water valve and cause the fill of said reaction chamber with water adjacent to the upper rim and wash out remnant developer solution from said reaction chamber and X-ray films therein;

said control means operates to open said drain valve to remove developer-contaminated wash water from said reaction chamber;

said control means operates to close said drain valve;

said control means operates to open said fixer storage reservoir feed line valve and activate said first force means which flows fixer into said reaction chamber immersing said X-ray films in fixer solution;

once said X-ray films are properly fixed, said control means operates to activate said second force means which returns said fixer solution to said fixer storage reservoir;

said control means operates to close said feed line valve and terminate said second force means, sealing fixer solution in said fixer storage reservoir;

said control means operates said water valve to fill said reaction chamber with water and thereby wash out remnant fixer solution from said reaction chamber and X-ray films;

said control means operates to open said drain valve to remove fixer- contaminated wash water from said reaction chamber;

said control means operates to close said drain valve;

said control means operates a blower/heater mechanism configured to force warm air on wet X-ray films within said reaction chamber thereby drying said X-ray films.

2. The device of claim 1 further comprising overflow drain lines fluidly coupled to each said first, second, or n reaction chambers adjacent to said upper rims.

3. The device of claim 1 further comprising a dryer mechanism for each first, second, and n reaction chamber comprising an air blowing device with air heater device configured and disposed to dry said X-ray films in each said first, second, and n reaction chamber once final wash has been completed.

4. The device of claim 1 wherein each said first, second, and n reaction chamber upper rim further comprises a cover plate selectively attachable to said upper rim, said cover plate having an inner surface and an outer surface and being movable between an open position and a closed position whereat said cover member is in abutting contact with said upper rim.

5. The device of claim 1 further comprising an X-ray film mounting cassette, said film cassette being sized and configured to accept at least one previously exposed X-ray film, and attachable so that said X-ray film resides completely within said first, second, and n reaction chambers in a manner that would completely submerge said at least one X-ray film with chemical flowed therein.

6. A method for processing X-ray films in an automated static X-ray film processor that will allow for the running of additional processing cycles of X-ray films while a previous cycle is running, comprising the steps of:

a primary operator placing one or a plurality of exposed X-ray films and holders into a primary unused reaction chamber, then operating a control means which opens valve and feed line configured to fluidly communicate with said primary reaction chamber and a developer storage reservoir, and, further, activates a first force means causing the flow of developer solution into said primary reaction chamber, thereby immersing said exposed X-ray films in developer solution;

a secondary operator wishing to process X-ray films places one or a plurality of exposed X-ray films and holders in a secondary unused reaction chamber while a previous cycle is running in said primary reaction chamber, then operates said control means which, as chemicals are available from said primary cycle, opens a valve and feed line configured to fluidly communicate with said secondary reaction chamber and said developer storage reservoir, and, further, activates said first force means causing developer solution to flow into said secondary reaction chamber, thereby immersing said exposed X-ray films and holders in developer solution;

an additional operator wishing to process X-ray films places one or a plurality of exposed X-ray films and holders in one of said n unused reaction chambers while previous cycles are running in other said primary and secondary reaction chambers, then operates said control means which, as chemicals are available, opens a valve and feed line configured to fluidly communicate with said n reaction chambers and said developer storage reservoir, and, further, activates said first force means causing developer solution to flow into said n reaction chamber, thereby immersing said exposed X-ray films in developer solution;

processing cycles of each said primary, secondary, or n reaction chambers continue individually to completion;

said primary operator removes processed X-ray films from said primary reaction chamber, making said primary reaction chamber available for another set of X-ray films to be processed, and a new cycle to be commenced, which may run in overlapped successive cycles with other X-ray film being processed in other reaction chambers;

said secondary operator removes processed X-ray films from said secondary reaction chamber, making said secondary reaction chamber available for another set of X-ray films to be processed, and a new cycle to be commenced, which may run in overlapped successive cycles with other X-ray films being processed in other reaction chambers;

said n operator removes processed X-ray films from said n reaction chamber, making said n reaction chamber available for another set of X-ray films to be processed, and a new cycle to be commenced, which may run in overlapped successive cycles with other X-ray films being processed in other reaction chambers.

* * * * *